US012352449B2

(12) United States Patent
Cadima et al.

(10) Patent No.: US 12,352,449 B2
(45) Date of Patent: Jul. 8, 2025

(54) COOKTOP INCLUDING A SINGLE INPUT CONTROL OF MULTIPLE HEATING ELEMENTS

(71) Applicant: Haier US Appliance Solutions, Inc., Wilmington, DE (US)

(72) Inventors: Paul Bryan Cadima, Crestwood, KY (US); Omar Santana, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 399 days.

(21) Appl. No.: 17/902,001

(22) Filed: Sep. 2, 2022

(65) Prior Publication Data

US 2024/0077206 A1 Mar. 7, 2024

(51) Int. Cl.

| | |
|---|---|
| ***F24C 3/12*** | (2006.01) |
| ***F23N 1/00*** | (2006.01) |
| ***F24C 3/08*** | (2006.01) |

(52) U.S. Cl.

CPC ..... *F24C 3/126* (2013.01); *F23N 1/005* (2013.01); *F24C 3/08* (2013.01); *F23N 2225/16* (2020.01); *F23N 2235/14* (2020.01); *F23N 2237/02* (2020.01); *F23N 2241/08* (2020.01)

(58) Field of Classification Search

CPC ..... F23K 5/005; F23N 1/005; F23N 5/022; F24C 3/126; F24C 3/085; F24C 3/103

USPC ..... 126/39 G, 39 E, 39 R, 39 H, 39 N, 42

See application file for complete search history.

(56) References Cited

U.S. PATENT DOCUMENTS

| | | | | |
|---|---|---|---|---|
| 1,445,984 | A * | 2/1923 | Wilkinson | F24C 3/12 126/39 J |
| 6,253,761 | B1 * | 7/2001 | Shuler | F24C 3/126 126/39 BA |
| 7,255,100 | B2 | 8/2007 | Repper | |
| 9,562,686 | B2 | 2/2017 | San Miguel Arenaza | |
| 9,841,191 | B2 * | 12/2017 | Johncock | F23N 1/002 |
| 10,584,871 | B2 | 3/2020 | Biagioli | |
| 10,619,858 | B2 | 4/2020 | Paller | |
| 10,935,250 | B2 | 3/2021 | Querejeta Andueza | |

(Continued)

FOREIGN PATENT DOCUMENTS

| | | |
|---|---|---|
| CN | 201241956 Y | 5/2009 |
| CN | 106871168 B | 9/2020 |

(Continued)

*Primary Examiner* — Vivek K Shirsat

(74) *Attorney, Agent, or Firm* — Dority & Manning, P.A.

(57) ABSTRACT

A cooktop appliance includes a first heating element; a second heating element adjacent to the first heating element; a first supply line in upstream fluid communication with the first heating element to direct fuel thereto; a second supply line in upstream fluid communication with the second heating element to direct fuel thereto, the second supply line being in fluid parallel with the first supply line; a first supply valve provided on the first supply line upstream from the first heating element; a second supply valve provided on the second supply line; a supplemental line providing fluid connection from the first supply valve to each of the first supply line and the second supply line; a supplemental line valve provided on the supplemental line; and a controller operably coupled with the supplemental line valve, the controller being configured to selectively open the supplemental line valve.

16 Claims, 8 Drawing Sheets

(56) References Cited

U.S. PATENT DOCUMENTS

| | | | | |
|---|---|---|---|---|
| 2002/0073985 | A1 | 6/2002 | Leukhardt | |
| 2011/0294078 | A1* | 12/2011 | Gartner | F24C 3/126<br>126/39 BA |
| 2019/0309954 | A1 | 10/2019 | Querejeta Andueza | |
| 2020/0300507 | A1 | 9/2020 | Cowan | |
| 2020/0408413 | A1 | 12/2020 | Billman | |

FOREIGN PATENT DOCUMENTS

| | | | |
|---|---|---|---|
| CN | 111692408 | A | 9/2020 |
| JP | H10246424 | A | 9/1998 |
| WO | WO2020008088 | A2 | 1/2020 |

* cited by examiner

COOKTOP INCLUDING A SINGLE INPUT CONTROL OF MULTIPLE HEATING ELEMENTS

FIELD OF THE INVENTION

The present subject matter relates generally to cooktop appliances, and more particularly to selectively controlling multiple gas heating elements with a single input on a cooktop appliance.

BACKGROUND OF THE INVENTION

Cooking appliances, e.g., cooktops or ranges (also known as hobs or stoves), generally include one or more heated portions for heating or cooking food items within or on a cooking utensil placed on the heated portion. For instance, burners may be included with each heated portion. The heated portions utilize one or more heating sources to output heat, which is transferred to the cooking utensil and thereby to any food item or items that are disposed on or within the cooking utensil. For instance, a griddle may be provided to extend across one or more heated portions. When disposed above the heated portion, the griddle generally provides a substantially flat cooking surface.

When the griddle extends over at least two gas heating elements, each burner must be activated and controlled to provide heat to the griddle. Many cooking appliances, such as those utilizing gas burners, have individual control inputs for each heating element. Often, the control inputs are control knobs or dials utilizing analog inputs to adjust heat output or flame size. Thus, identically controlling two or more gas heating elements with independent analog inputs is difficult.

Accordingly, a cooktop appliance that obviates one or more of the above-mentioned drawbacks would be beneficial. In particular, a cooktop appliance utilizing matching control of at least two gas heating elements with a single input would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a cooktop appliance is provided. The cooktop appliance may include a first gas heating element; a second gas heating element adjacent to the first gas heating element; a first supply line in upstream fluid communication with the first gas heating element to direct fuel thereto; a second supply line in upstream fluid communication with the second gas heating element to direct fuel thereto; a first supply valve provided on the first supply line upstream from the first gas heating element; a second supply valve provided on the second supply line upstream from the second gas heating element; a supplemental line providing fluid connection from the first supply valve to each of the first supply line and the second supply line; a supplemental line valve provided on the supplemental line; and a controller operably coupled with the supplemental line valve, the controller being configured to selectively open the supplemental line valve.

In another exemplary aspect of the present disclosure, a method of operating a cooktop appliance is provided. The cooktop appliance may include a first heating element controlled by a first control input and a second heating element adjacent to the first heating element, the second heating element controlled by a second control input. The method may include determining that a setting of the first control input and a setting of the second control input are matched; detecting a presence of a cookware item covering both the first heating element and the second heating element; and enabling a predetermined cooking mode in response to determining the setting of the first and second control inputs and detecting the presence of the cookware item.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
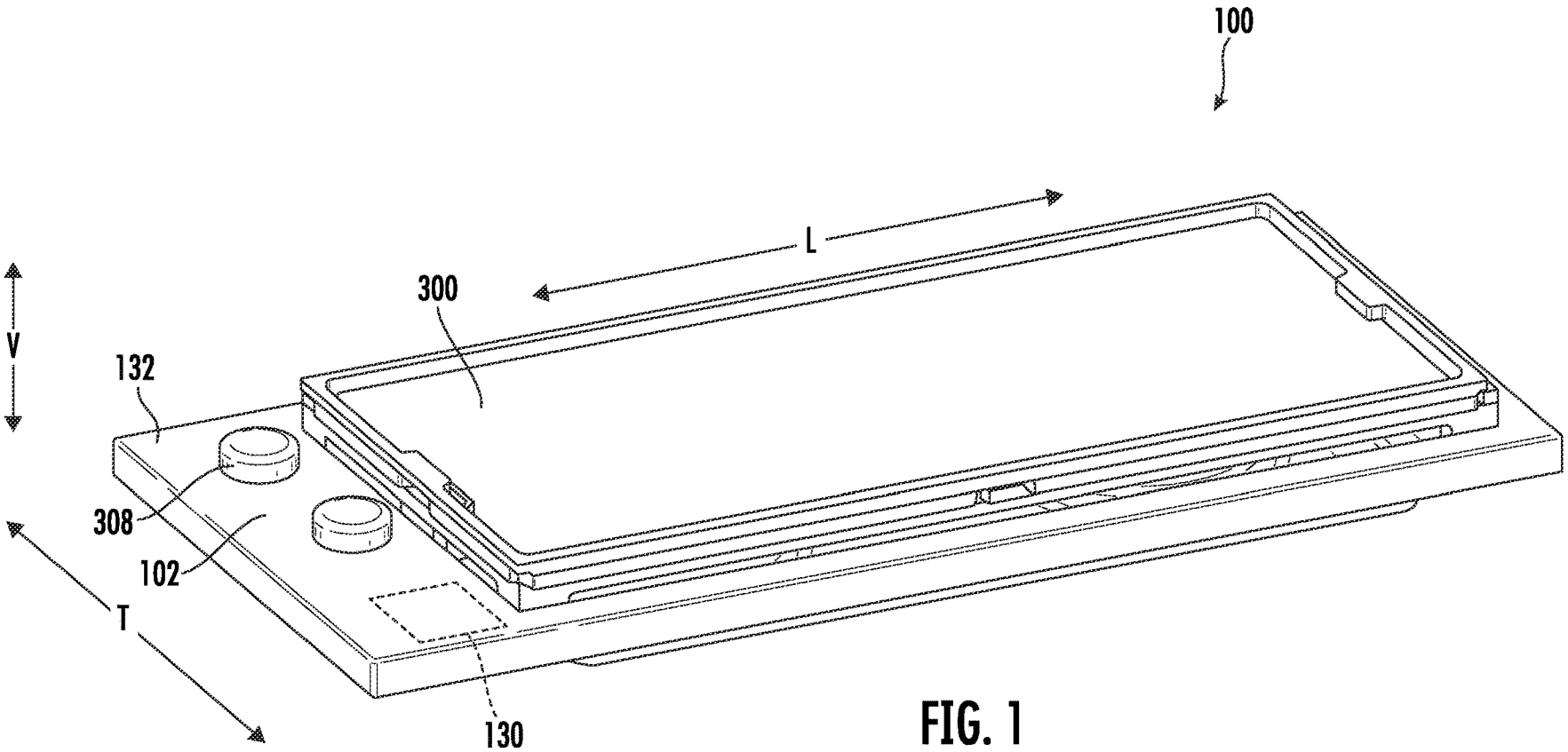
FIG. 1 provides a perspective view of a cooktop appliance according to one or more example embodiments of the present disclosure.
Figure 2:
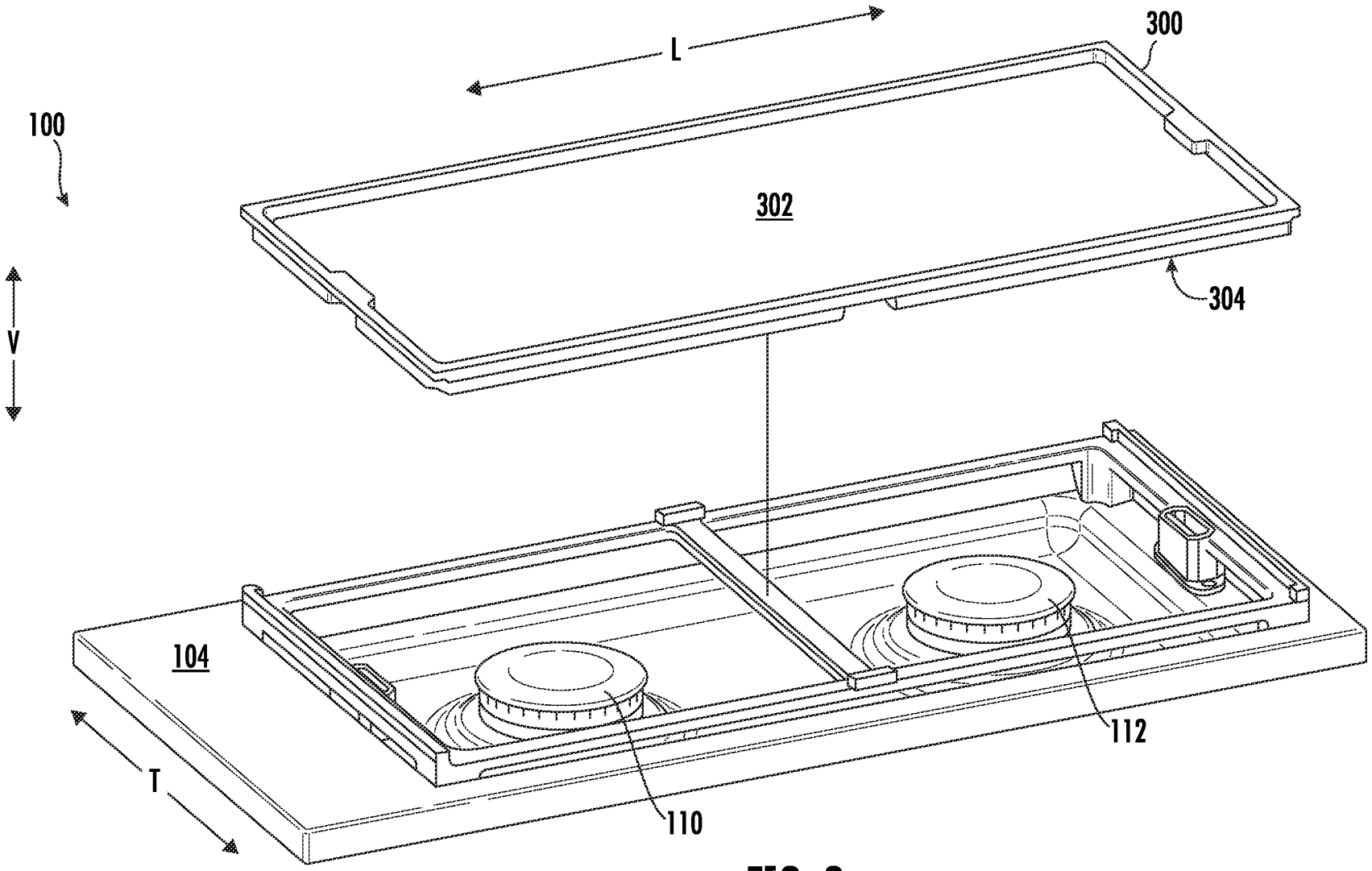
FIG. 2 provides a partially exploded view of the example cooktop appliance of FIG. 1.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIGS. 1 through 4 illustrate one or more example embodiments of a cooktop appliance 100 according to the present disclosure. The example cooktop appliance 100 may include a panel 102 that extends in a lateral direction L and a transverse direction T, e.g., perpendicular to a vertical direction V. Each of the vertical direction V, lateral direction L, and transverse direction T is mutually perpendicular to every other of the vertical direction V, the lateral direction L, and the transverse direction T, such that an orthogonal direction system is formed. By way of example, the panel 102 may be constructed of enameled steel, stainless steel, glass, ceramics, and combinations thereof.

In some embodiments, the cooktop appliance 100 may include a plurality of burners. For example, the cooktop appliance 100 may include a first burner 110 disposed on the panel 102 and a second burner 112 spaced apart from the first burner 110 on the panel 102. For example, as illustrated, the first burner 110 and the second burner 112 may be aligned along the transverse direction T and spaced apart along the lateral direction L. The panel 102 may also include a recessed portion, e.g., which extends downward along the vertical direction V. The first and second burners 110 and 112 may be positioned within the recessed portion. The recessed portion may collect spilled material, e.g., foodstuffs, during operation of the cooktop appliance.

The cooktop appliance 100 may also include a user interface panel 132 located within convenient reach of a user of the cooktop appliance 100. In various embodiments, the user interface panel may include user inputs 308, such as knobs, buttons, or a touchscreen, etc., which are generally understood by those of ordinary skill in the art and are therefore not shown or described in extensive detail herein for the sake of brevity and clarity. The user inputs 308 may allow the user to activate one or more burners and determine an amount of heat provided by each gas burner. The user interface panel 132 may also be provided with one or more graphical display devices that deliver certain information to the user, e.g., whether a particular burner is activated and/or the level at which the burner is set.

Cooktop appliance 100 is provided by way of example only, and it should be noted that the disclosure may apply to other cooktop appliances, such as stovetop appliances including three or more burners, each burner being independently operated by a dedicated user input (e.g., control knob) and associated gas supply valve (described below).

Operation of the cooktop appliance 100 may be regulated by a controller 130 that is operably coupled to (i.e., in operative communication with) the user inputs and/or gas burners. For example, in response to user manipulation of the user input(s), the controller 130 operates one or more of the burners 110, 112. By way of example, the controller 130 may include a memory and one or more processing devices such as microprocessors, CPUs or the like, such as general or special purpose microprocessors operable to execute programming instructions or micro-control code associated with operation of appliance 100. The memory may represent random access memory such as DRAM, or read only memory such as ROM or FLASH. In some embodiments, the processor may execute non-transitory programming instructions stored in memory. For example, the instructions may include a software package configured to operate appliance 100 and execute an operation routine such as one or more methods of operating the cooktop appliance. The memory may be a separate component from the processor or may be included onboard within the processor.

The controller 130 may be disposed in a variety of locations throughout appliance 100. Input/output ("I/O") signals may be routed between the controller 130 and various operational components of appliance 100, such as the gas burners 110, 112, inputs, a graphical display, one or more sensors, and/or one or more alarms.

In the illustrated example embodiments, each gas burner 110, 112 includes a generally circular shape from which a flame may be emitted. As shown, each gas burner 110, 112 includes a plurality of fuel ports is defined circumferentially in fluid communication with an internal passage of each respective burner 110, 112. In some embodiments, one or both of the first burner 110 and the second burner 112 may be a multi-ring burner. For example, the first burner 110 may include a first plurality of fuel ports defining a first ring of the burner 110 and a second plurality of fuel ports defining a second ring of the burner 110. In such embodiments, a first fuel chamber in fluid communication with the first plurality of fuel ports may be separated from a second fuel chamber in fluid communication with the second plurality of fuel ports by a wall within the burner 110, and fuel may be selectively supplied to one or both of the fuel chambers within burner 110. In some embodiments of a cooktop appliance, multiple burners of differing types may be provided in combination, e.g., one or more single-ring burners as well as one or more multi-ring burners. Moreover, other suitable burner configurations are also possible.

In some embodiments, the cooktop appliance may be configured for closed-loop cooking. For example, the controller 130 may be operable to receive a set temperature (such as from a user input of the cooktop appliance 100 or wirelessly from a remote device such as a smartphone) and to compare the set temperature to temperature measurements from one or more temperature sensors, such as a temperature sensor associated with each burner, and to automatically adjust each burner, such as a fuel flow rate to each burner, based on the comparison of the corresponding temperature measurement to the set temperature.

Thus, the controller 130 may be in operative communication with one or more temperature sensors. For example, the controller 130 may be selectively in operative communication with one or more embedded temperature sensors 310, 312 in a griddle plate 300, such as via pogo pin terminal blocks positioned on, e.g., mounted to, the panel 102. In some embodiments, the cooktop appliance 100 may therefore include at least one terminal block for connecting to the embedded temperature sensor(s) 310 and/or 312, such as a first pogo pin terminal block 150 and a second pogo pin terminal block 152.

As shown in FIGS. 1 through 4, the griddle plate 300 may be selectively disposed over (e.g., directly above) a corresponding spaced-apart pair of burners, e.g., first gas burner 110 and second gas burner 112. During use, top cooking surface 302 faces away from panel 102 to receive a cooking item (e.g., food) thereon. By contrast, a bottom heating surface 304 may be opposite from top cooking surface 302 and faces panel 102 during use. Thus, the bottom heating surface 304 may face panel 102 to receive a thermal output (e.g., flame or heated air) from the corresponding burners 110, 112. The bottom surface 304 of the griddle plate 300 may be supported on a frame when the griddle plate 300 is mounted on the frame. For example, the bottom surface of the griddle plate 300 may be in contact with the frame, such as with a peripheral support surface and an intermediate support surface thereof.

In some embodiments, the griddle plate 300 includes at least one embedded temperature sensor, e.g., a first embedded temperature sensor 310 and a second embedded temperature sensor 312, as illustrated. In other embodiments, the griddle plate 300 includes a single embedded temperature sensor which extends to at or about a geometric center of the griddle plate 300, such as the center of the cooking surface 302 in the lateral-transverse plane. The embedded temperature sensor(s) may be hermetically sealed. In some embodiments, the first embedded temperature sensor 310 is positioned above the first burner 110 and the second embedded temperature sensor 312 is positioned above the second burner 112. For example, the first embedded temperature sensor 310 may be positioned directly above the first burner 110 along the vertical direction V and the second embedded temperature sensor 312 may be positioned directly above the second burner 112 along the vertical direction V. The first embedded sensor 310 and the second embedded sensor 312 may be positioned between the bottom surface 304 and the top surface 302 of the griddle plate 300. The embedded sensors 310 and 312 may be spaced apart from each of the bottom surface 304 and the top surface 302 of the griddle plate 300.

Figure 3:
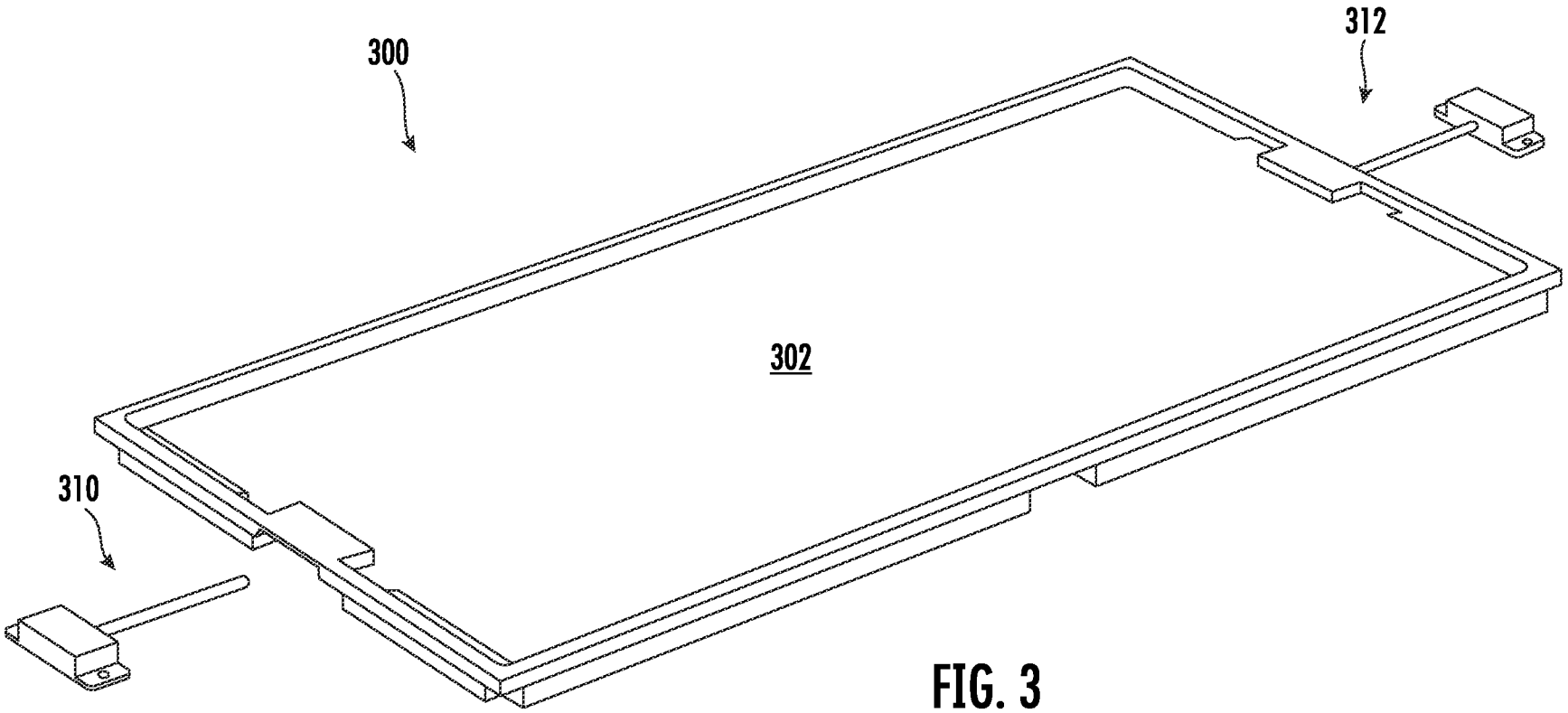
FIG. 3 provides a top perspective view of a griddle plate and a temperature sensor therefor such as may be incorporated into a cooktop appliance according to one or more embodiments of the present disclosure.
Figure 4:
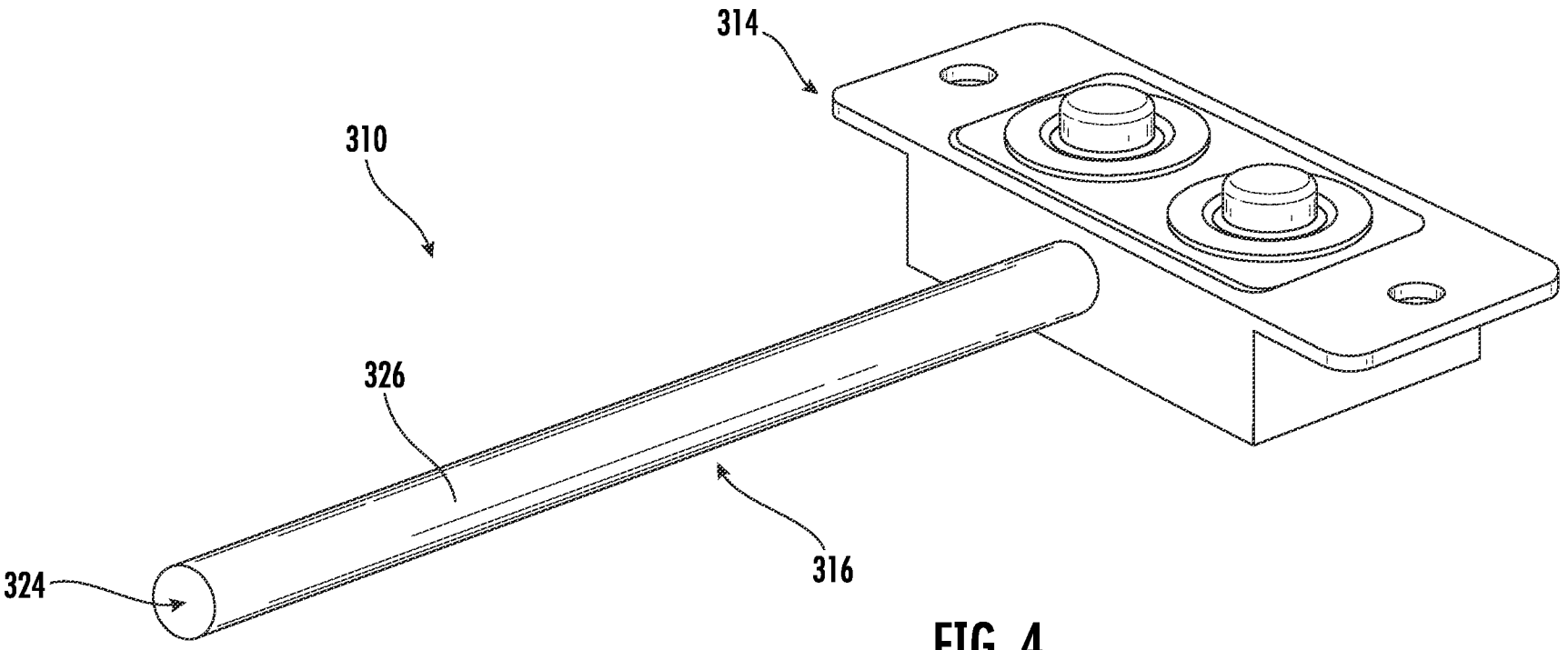
FIG. 4 provides a perspective view of a temperature sensor such as may be incorporated into a cooktop appliance according to one or more embodiments of the present disclosure.

FIG. 3 provides an exploded perspective view of the griddle plate 300 with the first embedded temperature sensor 310 and the second embedded temperature sensor 312 removed from the griddle plate 300. In some embodiments, the first embedded temperature sensor 310 and the second embedded temperature sensor 312 each include a base 314 and a probe 316. The probe 316 may be or include any suitable temperature sensor, such as a thermistor or a thermocouple, among other possible examples. For example, as illustrated in FIG. 4, the sensor 324 may be disposed within a sheath 326 of the probe 316, and the sheath 326 may be attached to the base 314.

As used herein, "temperature sensor" or the equivalent is intended to refer to any suitable type of temperature measuring system or device positioned at any suitable location for measuring the desired temperature. Thus, for example, temperature sensor 310 or 312 may each be any suitable type of temperature sensor, such as a thermistor, a thermocouple, a resistance temperature detector, a semiconductor-based integrated circuit temperature sensors, etc. In addition, temperature sensor 310 or 312 may be positioned at any suitable location and may output a signal, such as a voltage, to a controller that is proportional to and/or indicative of the temperature being measured. Although exemplary positioning of temperature sensors is described herein, it should be appreciated that cooktop appliance 100 may include any other suitable number, type, and position of temperature and/or other sensors according to alternative embodiments.

As mentioned above, the cooktop appliance 100 may include a controller 130 and the griddle plate 300 may include first and second embedded temperature sensors, e.g., thermistors, 310 and 312. The first and second embedded temperature sensors 310 and 312 of the griddle plate 300 may be selectively in operative communication with the controller 130, e.g., may be in operative communication with the controller 130 via a connection between first and second pogo pin terminal blocks on the panel 102 and respective pogo pin connectors on each temperature sensor 310 and 312 when the griddle plate 300 is mounted on the frame while the frame is mounted on the panel 102.

For example, the controller 130 may be operable in a griddle mode and/or configured to operate in a griddle mode. As will be explained in further detail below, the griddle mode may comprise coordinating operation of the first and second burners 110 and 112 to provide consistent or uniform heating across the griddle plate, e.g., when the griddle plate 300 is mounted on the frame and the frame is mounted on the panel 102 such that the first and second embedded temperature sensors 310 and 312 are in communication with the controller 130 via the pogo pin connections described above.

FIGS. 5 through 8 illustrate an exemplary view of a control knob (or user input) 308 in accordance with an embodiment. For instance, control knob 308 may be user input 134 or another similar knob for controlling a heat output of a connected heating element (e.g., gas burner 110 or 112—FIG. 2). The knob 308 may be generally rotatable about an axis 600. Knob 308 may include an input 348 (e.g., a temperature input ring). The input 348 may also be rotatable about an axis. The axis of the input 348 may be coaxial with the axis 600 of the knob 308.

Figure 5:
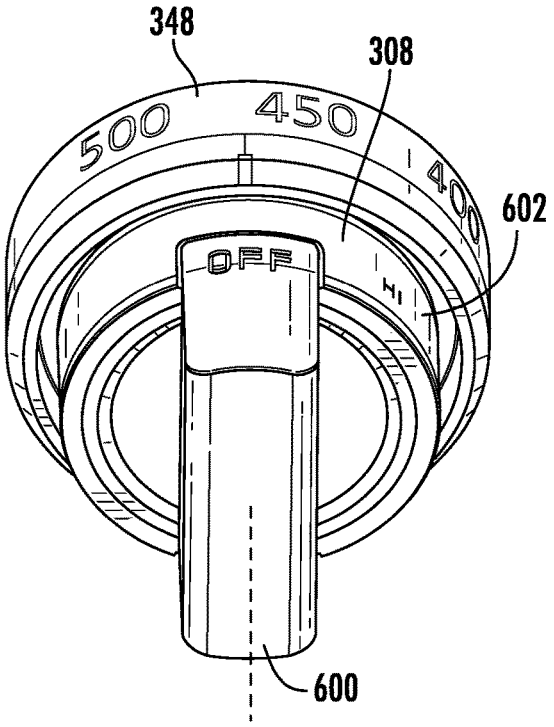
FIG. 5 is a perspective view of a knob for controlling the control assembly in accordance with embodiments of the present disclosure, as seen in a first position associated with a manual operating mode.
Figure 6:
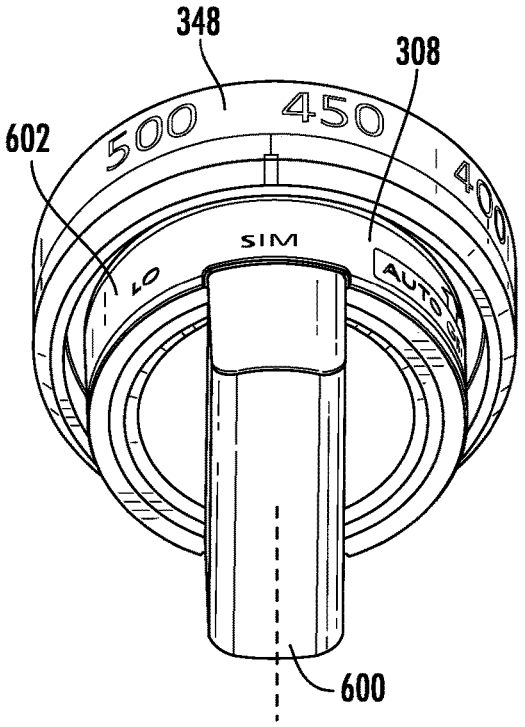
FIG. 6 is a perspective view of the knob for controlling the control assembly in accordance with embodiments of the present disclosure, as seen in a second position associated with the manual operating mode.
Figure 7:
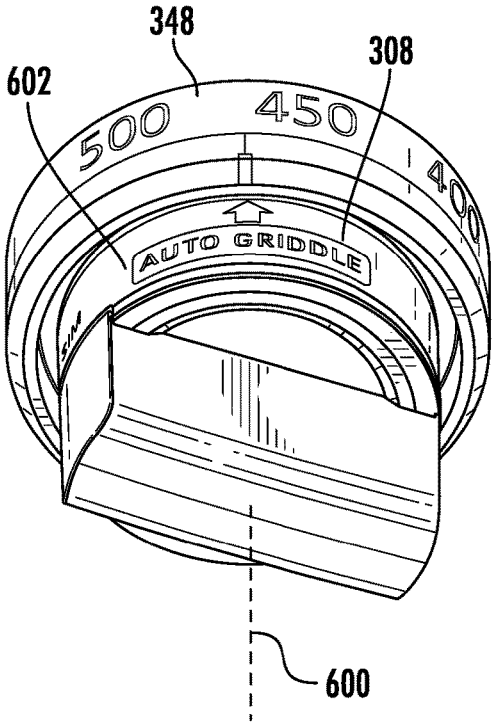
FIG. 7 is a perspective view of the knob for controlling the control assembly in accordance with embodiments of the present disclosure, as seen in a position associated with an automatic operating mode.
Figure 8:
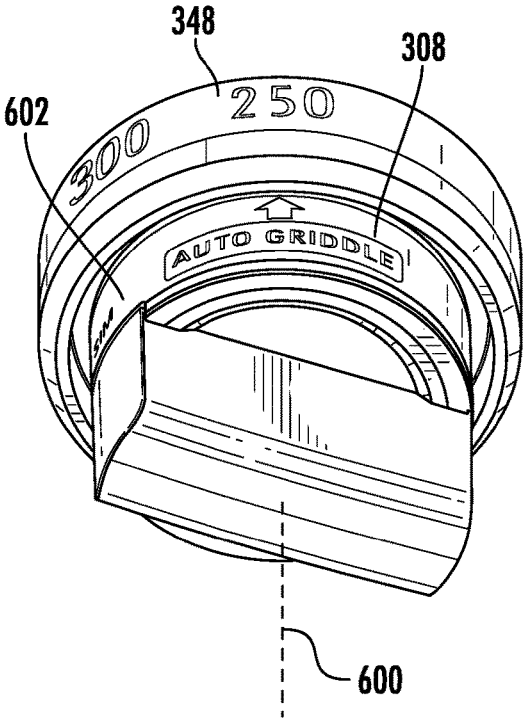
FIG. 8 is a perspective view of the knob for controlling the control assembly in accordance with embodiments of the present disclosure, as seen in a position associated with the automatic operating mode.

The knob 308 may include indicia 602 which corresponds with a relative operating condition of the cooking appliance. For instance, the indicia 602 may correspond with a low temperature, marked as "LO", a high temperature, marked as "HI", a simmer temperature, marked as "SIM", and an automatic operating mode, marked as "AUTO GRIDDLE". For the embodiments described herein, it should be understood that the "AUTO GRIDDLE" input corresponds to a minimum flow of fuel (e.g., as provided by a supply valve to a gas burner). Thus, when knob 308 is turned to "AUTO GRIDDLE," the supply valve (described below) provides a minimum flow of fuel (e.g., gas) to the corresponding gas burner. The knob 308 illustrated in FIG. 5 is disposed in the OFF position whereby a corresponding gas burner (e.g., burner 110, 112) receives no gas flow. The knob 308 illustrated in FIG. 6 is in a simmer mode whereby the cooktop appliance is operating in a manual mode at a simmer setting. The knob 308 illustrated in FIG. 7 is in an automatic operating mode with the input 348 set for approximately 465 degrees Fahrenheit. The knob 308 illustrated in FIG. 8 is in the automatic operating mode with the input 348 set for approximately 250 degrees Fahrenheit. The knob 308 may be infinitely adjustable. That is, the knob 308 may be adjustable to any location between rotational end points or stops. It should be understood that rotating the knob 308 between the HI and SIM settings may allow for the operator to adjust the flame to any desired flame height. In certain instances, the cooktop appliance may include a tactile feedback when the knob 308 is rotated from the manual operating mode to the automatic operating mode. The tactile feedback may include, for example, a detent or the like which causes a tactile indication when rotated past. It should be understood that the input 348 may be set before or after the knob 308 is set to the automatic operating mode. Moreover, the operator may adjust the input 348 after the knob 308 is in the automatic operating mode position, thereby allowing the operator to change the temperature at the gas burner.

Figure 9:
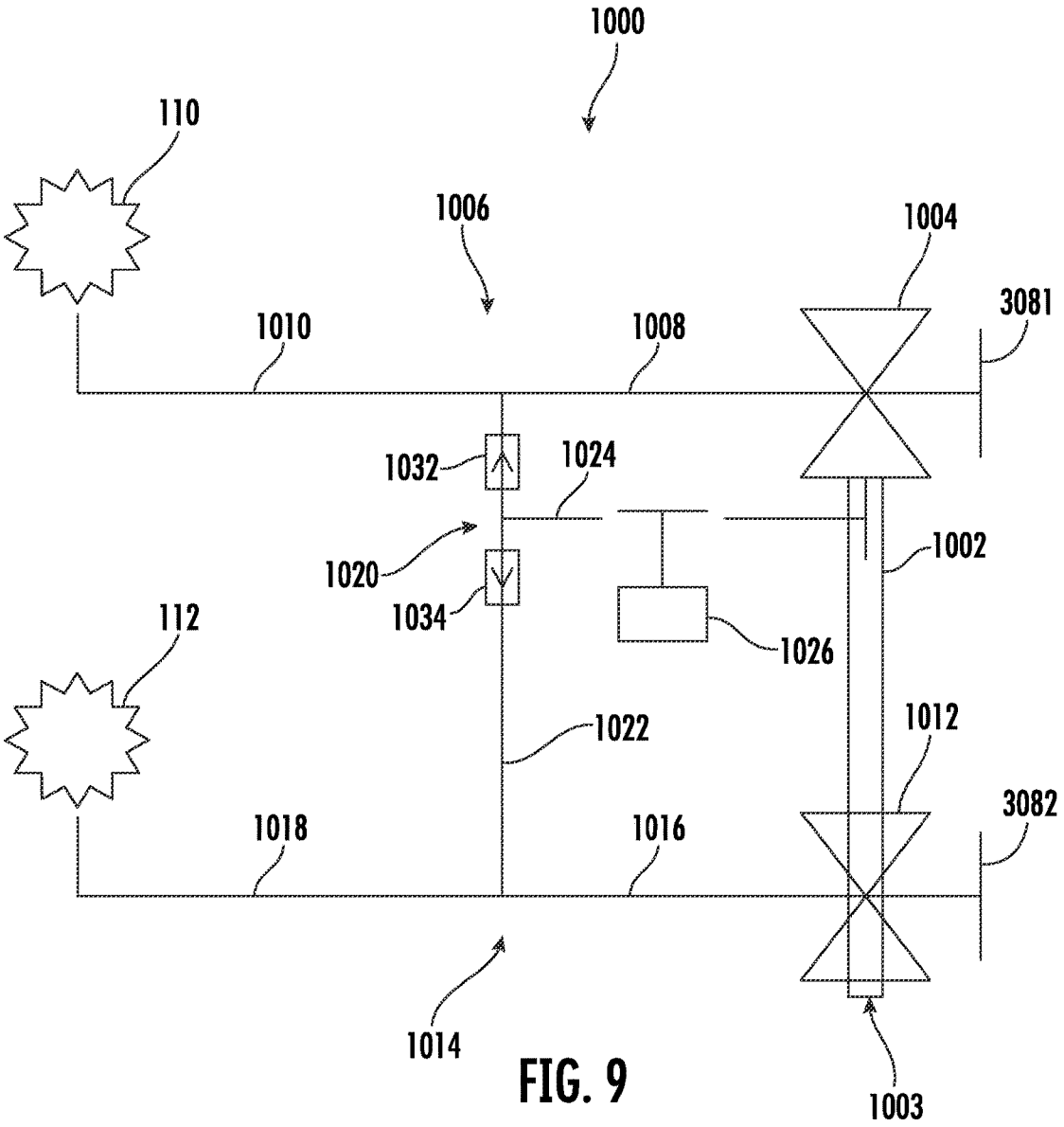
FIG. 9 is a schematic view of a cooktop appliance in accordance with embodiments of the present disclosure.
Figure 10:
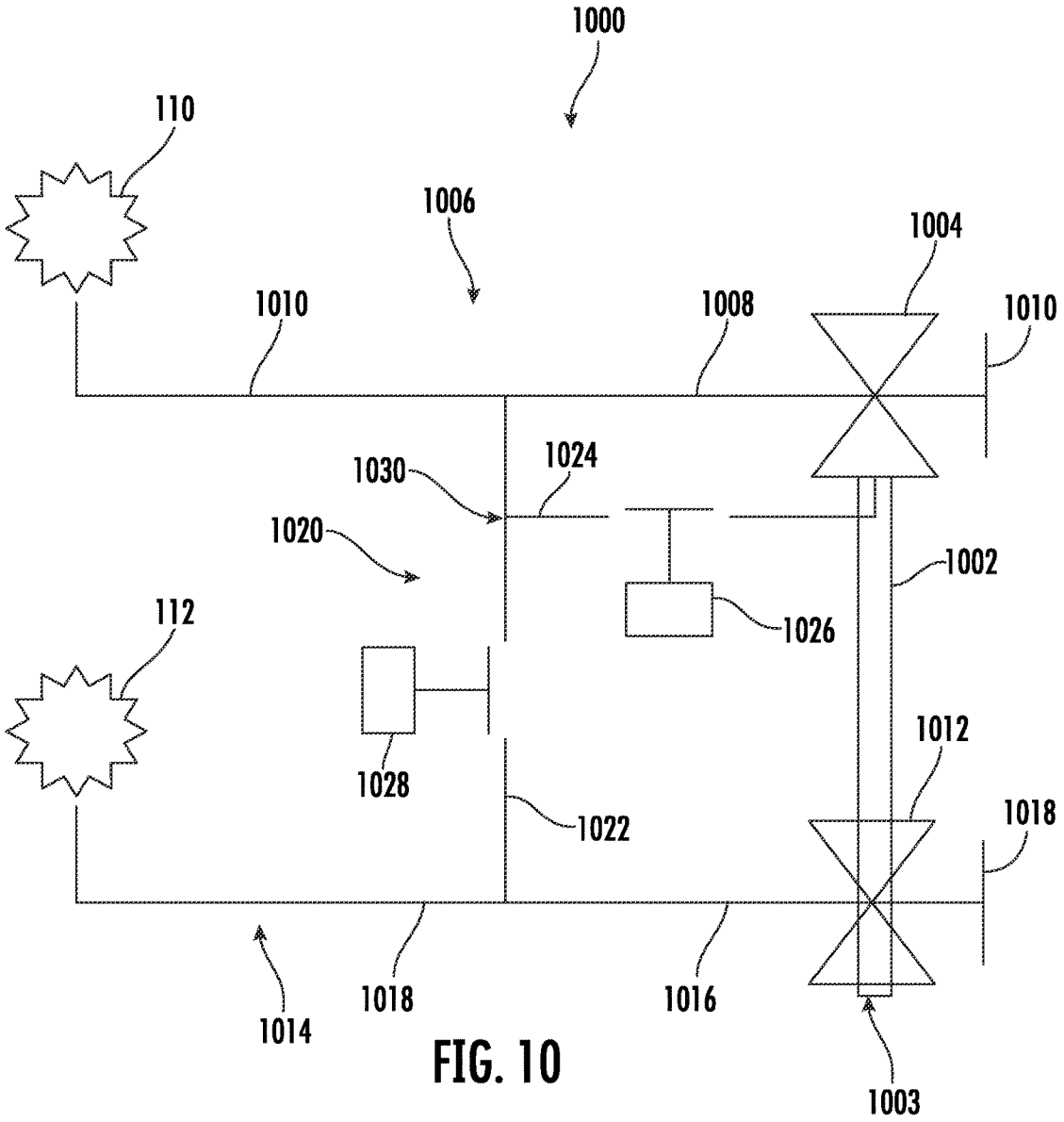
FIG. 10 is a schematic view of a cooktop appliance in accordance with embodiments of the present disclosure.

FIGS. 9 and 10 illustrate schematic views of exemplary cooktop appliances in accordance with embodiments described herein. More particularly, FIGS. 9 and 10 illustrate control assemblies used to control gas flow to one or more gas burners.

In the schematics shown, a control assembly 1000 is illustrated. Control assembly (or heating assembly) 1000 may be incorporated into cooktop appliance 100, for instance. Control assembly 1000 may include a manifold 1002. Manifold 1002 may be provided within, e.g., panel 102 of cooktop appliance 100. Manifold 1002 may include a gas inlet 1003 through which gas or fuel is supplied to manifold 1002 from, for instance, a municipal gas source. Accordingly, manifold 1002 may be a conduit through which the gas or fuel may flow (e.g., at a predetermined pressure).

Control assembly 1000 may include a first supply valve 1004. First supply valve 1004 may be fluidly connected with manifold 1002. For instance, the gas flowing through manifold 1002 may be selectively supplied to first supply valve 1004. First supply valve 1004 may be a manual valve controlled by a relative angular position of the knob 308. With first supply valve 1004 in the fully open position and control assembly 1000 in manual operating mode, gas can flow at a maximum flow rate to, e.g., first burner 110. With first supply valve 1004 in the closed position in manual operating mode, gas may not flow to first burner 110. Thus, the closed position of the first supply valve 1004 may restrict or halt gas flow to first burner 110. In certain instances, manifold 1002 may supply gas flow to one or more other control assemblies which may be tapped into or connected with manifold 1002.

Control assembly 1000 may include a first supply line 1006. First supply line 1006 may fluidly connect first supply valve 1004 with first burner 110. In detail, first supply line 1006 may be in upstream fluid communication with first burner 110 to direct fuel thereto. First supply line 1006 may be a conduit defining a passageway or channel through the fuel (e.g., gas) is selectively supplied to first burner 110. For instance, an amount of fuel supplied through first supply line 1006 may be dictated by a relative position of first supply valve 1004 (e.g., as influenced by knob 308).

Control assembly 1000 may include a second supply valve 1012. Second supply valve 1012 may be fluidly connected with manifold 1002. For instance, the gas flowing through manifold 1002 may be selectively suppled to second supply valve 1012. Second supply valve 1012 may be a manual valve controlled by a relative angular position of the knob 308. With second supply valve 1012 in the fully open position and control assembly 1000 in manual operating mode, gas can flow at a maximum flow rate to, e.g., second burner 112. With second supply valve 1012 in the closed position in manual operating mode, gas may not flow to second burner 112. Thus, the closed position of the second supply valve 1012 may restrict or halt gas flow to second burner 112. In certain instances, manifold 1002 may supply gas flow to one or more other control assemblies which may be tapped into or connected with manifold 1002.

Control assembly 1000 may include a second supply line 1014. Second supply line 1014 may fluidly connect second supply valve 1012 with second burner 112. In detail, second supply line 1014 may be in upstream fluid communication with second burner 112 to direct fuel thereto. Second supply line 1014 may be a conduit defining a passageway or channel through the fuel (e.g., gas) is selectively supplied to second burner 112. For instance, an amount of fuel supplied through second supply line 1014 may be dictated by a relative position of second supply valve 1012 (e.g., as influenced by knob 308). Additionally or alternatively, second supply line 1014 may be in fluid parallel with first supply line 1006.

Each of first supply valve 1004 and second supply valve 1012 may be controlled by a dedicated control knob 308. In detail, a first control knob (or first control input) 3081 may selectively control first supply valve 1004 and a second control knob (or second control input) 3082 may selectively control second supply valve 1012. Thus, each of first burner 110 and second burner 112 may be independently controlled by an individual control knob 3081, 3082 and supply valve 1004, 1012.

Control assembly 1000 may include a supplemental line 1020. Supplemental line 1020 may provide a fluid connection from first supply valve 1004 to each of first supply line 1006 and second supply line 1014 (e.g., during an automatic control operation). In detail, supplemental line 1020 may have a first end connected at first supply valve 1004. According to some embodiments, the first end of supplemental line 1020 is fluidly coupled to an outlet of first supply valve 1004. Supplemental line 1020 may be a fixed flow line. In detail, supplemental line 1020 may constantly receive a manifold pressure of fuel or gas (e.g., a maximum pressure within manifold 1002). Accordingly, supplemental line 1020 may selectively provide a predetermined amount of fuel to each of first supply line 1006 and second supply line 1014.

Control assembly 1000 may include a supplemental line valve 1026. Supplemental line valve 1026 may be in fluid communication with supplemental line 1020. In detail, supplemental line valve 1026 may be attached in line with supplemental line 1020 to selectively open and close supplemental line 1020. Supplemental line valve 1026 may be operably connected with controller 130. For instance, supplemental line valve 1026 may selectively open and/or close according to an input signal from controller 130. Additionally or alternatively, supplemental line valve 1026 may selectively open and/or close according to an input from a control knob (e.g., first control knob 3081). For example, if a user rotates first control knob 3081 to the "AUTO GRIDDLE" setting, a signal is sent to supplemental line valve 1026 to open (e.g., during a griddle operation mode, explained below).

Supplemental line 1020 may include a bridge portion 1022 and a source portion 1024. In detail, bridge portion 1022 may connect first supply line 1006 to second supply line 1014. Source portion 1024 may fluidly connect bridge portion 1022 to first supply valve 1004. Thus, source portion 1024 may extend from first supply valve 1004 to bridge portion 1024 to supply the fuel thereto. Bridge portion 1022 may then supply the fuel to each of first supply line 1006 and second supply line 1014. Advantageously, a matching fuel pressure may be supplied to each of first burner 110 and second burner 112. For example, when operating in the griddle mode, a griddle plate (e.g., griddle plate 300) covering first burner 110 and second burner 112 may be more evenly heated by increasing or decreasing the heat output of first burner 110 and second burner 112 in concert.

Supplemental line valve 1026 may be positioned on source portion 1024. For instance, supplemental line valve 1026 may be positioned between first supply valve 1004 and bridge portion 1022. Accordingly, when supplemental line valve 1026 is opened, fuel is supplied to each of first supply line 1006 and second supply line 1014 (e.g., at a matching pressure or amount to each). Similarly, when supplemental line valve 1026 is closed, the supplemental fuel (e.g., at manifold pressure) is not supplied to either first supply line 1006 or second supply line 1014.

First supply line 1006 may include a first portion 1008 and a second portion 1010. In detail, first portion 1008 may extend from first supply valve 1004. The flow of fuel from first supply valve 1004 may thus enter first portion 1008 of first supply line 1006. Bridge portion 1022 of supplemental line 1020 may connect with first supply line 1006 at a terminus of first portion 1008. For instance, fuel supplied from first supply valve 1004 into first portion 1008 may selectively mix with supplemental fuel supplied into supplemental line 1020 (e.g., via bridge portion 1022). Accordingly, second portion 1010 may selectively include fuel from first portion 1008 and bridge portion 1022. For example, during an operation (e.g., an automatic operation), a minimum flow is supplied to first burner 110 through first supply line 1006. A maximum flow may be temporarily added to the minimum flow via supplemental line 1020 by opening supplemental line valve 1026. Thus, a heat output of first burner 110 may be controlled via supplemental line valve 1026 without an adjustment of first control knob 3081.

Second supply line 1014 may include a first portion 1016 and a second portion 1018. In detail, first portion 1016 may extend from second supply valve 1012. The flow of fuel from second supply valve 1012 may thus enter first portion 1016 of second supply line 1014. Bridge portion 1022 of supplemental line 1020 may connect with second supply line 1014 at a terminus of first portion 1016. For instance, fuel supplied from second supply valve 1012 into first portion 1016 may selectively mix with supplemental fuel supplied into supplemental line 1020 (e.g., via bridge portion 1022). Accordingly, second portion 1018 may selectively include fuel from first portion 1016 and bridge portion 1022. For example, during an operation (e.g., an automatic operation), a minimum flow is supplied to second burner 112 through second supply line 1014. A maximum flow may be temporarily added to the minimum flow via supplemental line 1020 by opening supplemental line valve 1026. Thus, a heat output of second burner 112 may be controlled via supplemental line valve 1026 without an adjustment of second control knob 3082.

As mentioned above, cooktop appliance 100 may selectively operate in a griddle mode. The griddle mode may include placing or attaching a griddle plate (e.g., griddle plate 300) over each of first and second burners 110 and 112. For instance, one or more sensors (e.g., including or separate from temperature sensors 310 and 312) may be included on one of griddle plate 300 or cooktop appliance 100. Controller 130 may determine a presence of griddle plate 300 via the one or more sensors. For instance, controller 130 may establish a connection with temperature sensors 310 and 312 and thus deduce that griddle plate 300 is attached (e.g., to or over first and second burners 110 and 112). Additionally or alternatively, controller 130 may detect the presence of griddle plate 300 via one or more other means, such as a wireless connection between griddle plate 300 and cooktop appliance 100, a camera, a weight sensor, an optic sensor, a proximity sensor, or the like.

Control system 1000 maya include a pair of check valves. In detail, the pair of check valves may include a first check valve 1032. First check valve 1032 may be provided on supplemental line 1020 (e.g., bridge portion 1022). First check valve 1032 may be located fluidly between source portion 1024 and first supply line 1006. First check valve 1032 may be configured to allow a flow of fuel in only one direction (e.g., through supplemental line 1024). For instance, first check valve 1032 may allow fuel to flow from source portion 1024 into first supply line 1006. Accordingly, first check valve 1032 may prohibit fuel from flowing from first supply line 1006 (e.g., first portion 1008) through supplemental line 1020 and into second supply line 1014. Advantageously, fuel may not be inadvertently supplied to an unused burner (e.g., when only first burner 110 is used) via supplemental line 1020.

The pair of check valves may include a second check valve 1034. Second check valve 1034 may be provided on supplemental line 1020 (e.g., bridge portion 1022). Second check valve 1032 may be located fluidly between source portion 1024 and second supply line 1014. Second check valve 1034 may be configured to allow a flow of fuel in only one direction (e.g., through supplemental line 1024). For instance, second check valve 1034 may allow fuel to flow from source portion 1024 into second supply line 1014. Accordingly, second check valve 1034 may prohibit fuel from flowing from second supply line 1014 (e.g., first portion 1016) through supplemental line 1020 and into first supply line 1006. Advantageously, fuel may not be inadvertently supplied to an unused burner (e.g., when only second burner 112 is used) via supplemental line 1020.

Referring briefly to FIG. 10, a control system 1000 according to another embodiment is provided. In FIG. 10, like reference numerals refer to like elements. As such, a detailed description of repeat elements will be foregone for the sake of brevity. According to some embodiments, control system 1000 includes a bridge valve. Bridge valve 1028 may be provided on bridge portion 1022. In detail, bridge valve 1028 may be positioned between second supply line 1014 and a connection point 1030 between source portion 1024 and bridge portion 1022. Accordingly, bridge valve 1028 may selectively open or close a fluid communication between source portion 1024 and second supply line 1014. For example, when only first burner 110 is operational, bridge valve 1028 is closed to prohibit a flow of supplemental fuel from source portion 1024 to second supply line 1014. Thus, in the griddle mode, bridge valve 1028 is opened to allow fluid communication between source portion 1024 and second supply line 1014.

Supplemental line valve 1026 may be a solenoid valve. For instance, supplemental line valve 1026 may be a normally closed solenoid valve. Supplemental line valve 1026 may be controllable between a fully closed position and a fully open position. Accordingly, supplemental fuel from manifold 1002 may be selectively supplied to first supply line 1006 or each of first supply line 1006 and second supply line 1014 at an equal pressure. Bridge valve 1028 may be a solenoid valve. For instance, bridge valve 1028 may be a normally closed solenoid valve. Bridge valve 1028 may be controllable between a fully closed position and a fully open position. Accordingly, supplemental fuel from manifold 1002 may be selectively supplied to second supply line 1014 according to the position of bridge valve 1028. For instance, when bridge valve 1028 is closed, only first burner 110 may be cycled between a high and a low setting (e.g., high and low flame output). Second burner 112 may be prohibited from receiving fuel from supplemental line 1020 due to the closed position of bridge valve 1028.

Figure 11:
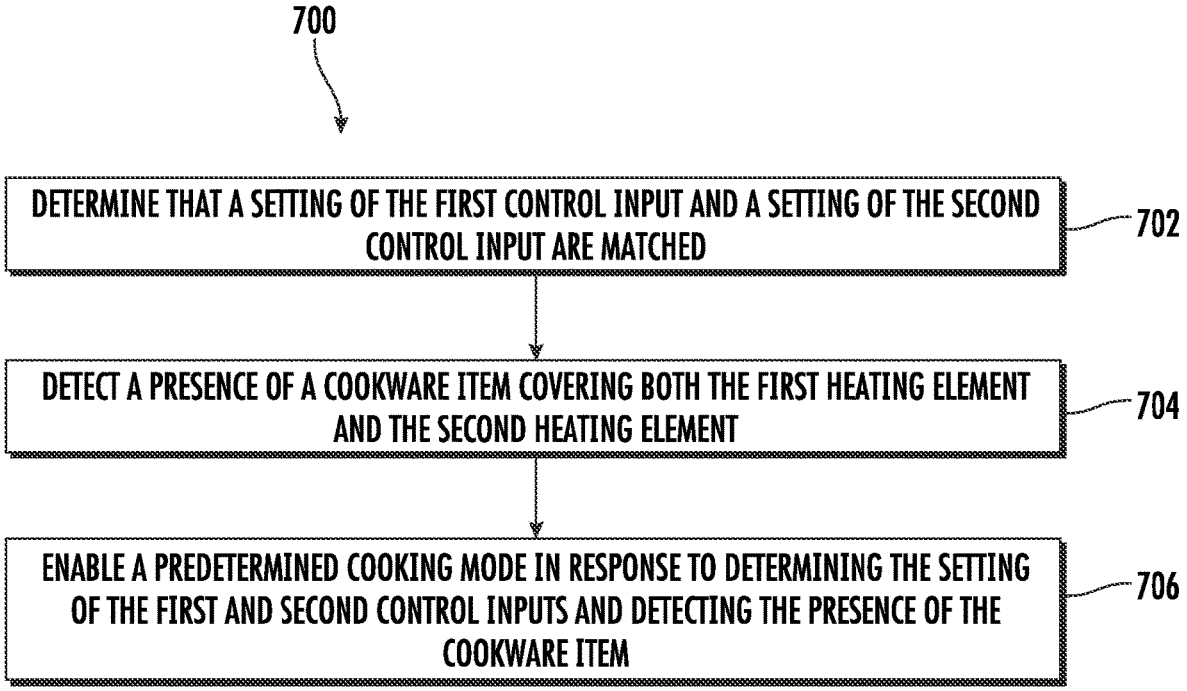
FIG. 11 is a flow chart of a method of using a cooktop appliance in accordance with embodiments of the present disclosure.
Figure 12:
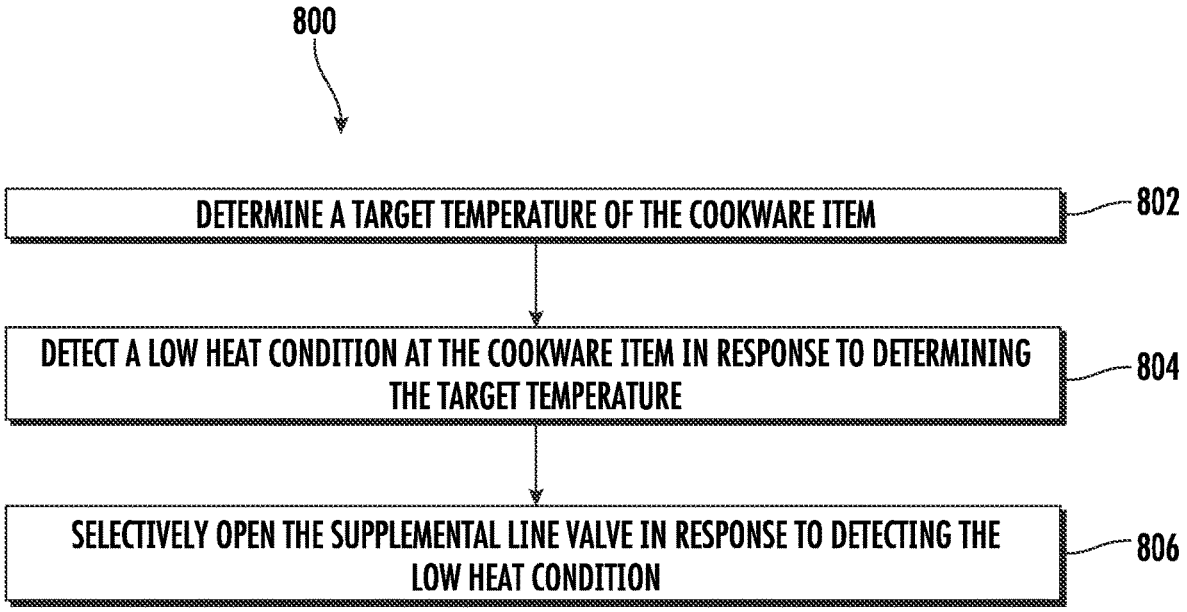
FIG. 12 is a flow chart of a method of using a cooktop appliance in accordance with embodiments of the present disclosure.

Referring now to FIGS. 11 and 12, methods 700 and 800 will be described in detail. It should be noted that methods 700 and 800 may be performed by a controller (e.g., controller 130) onboard cooktop appliance 100 or a separate, dedicated controller. Further, methods 700 and 800 may be performed on any suitable cooktop appliance, such as any stovetop with two or more burners.

At step 702, method 700 may include determining that a setting of a first control input and a setting of a second control input are matched. In detail, a setting of the first control input (e.g., first control knob 3081) may be determined and a setting of the second control input (e.g., second control knob 3082) may be determined. The method 700 may include matching the setting of each of the first and second control inputs (e.g., such that each control input is disposed in a corresponding setting that is preset to match the other). For one example, step 702 may include determining the first control input is set to "AUTO GRIDDLE" and the second control input is set to "AUTO GRIDDLE". For instance, each of the first control input and the second control input may include a tactile feedback feature such as a detent to notify a user as to the precise position of the control input.

At step 704, method 700 may include detecting a presence of a cookware item covering both a first heating element and a second heating element. In detail, as described above, one or more sensors (e.g., temperature sensors, proximity sensors, contact sensors, etc.) may detect or determine a presence of a cookware item covering at least two heating elements (e.g., first burner 110 and second burner 112 detected via an established connection at a pair of corresponding temperature sensors). The cookware item may be a griddle pan. For instance, the cookware item may be selectively attached to each of the first heating element and the second heating element.

At step 706, method 700 may include enabling a predetermined cooking mode in response to determining the setting of the first and second control inputs and detecting the presence of the cookware item. For instance, the predetermined cooking mode may be a griddle mode. As described above, the cookware item may be a griddle pan attached to or otherwise covering both the first and second heating elements. The method 700 may notably ensure that the cookware item is present and the control inputs are matched (e.g., corresponding to an automatic operation). For example, only when each element is satisfied will the method enable the predetermined cooking mode. Thus, if the first control input is at a first setting and the second control input is at a second setting different from the first setting, the method 700 may not enable or otherwise permit the predetermined cooking mode.

The predetermined cooking mode may be a manual cooking mode or an automatic cooking mode. For instance, upon determining that both elements are satisfied, the method 700 may proceed to initiate an automatic cooking mode. The automatic cooking mode may be performed according to one or more requirements or rules, explained below with respect to method 800. Similarly, upon determining that both elements are satisfied, the method 700 may proceed to initiate a manual cooking mode. According to the manual cooking mode, a single control input (e.g., first control knob 3081) may be used to adjust a heat output of both the first heating element (e.g., first burner 110) and the second heating element (e.g., second burner 112). For example, with respect to cooktop appliance 100, the manual cooking mode may advantageously allow a user to adjust a single control knob to selectively supply fuel at an equal pressure to each of the first heating element and the second heating element via the supplemental line and supplemental line valve.

Referring now to FIG. 12, at step 802, method 800 may include determining a target temperature of the cookware item. In detail, the method 800 may include receiving one or more inputs relating to a desired temperature at the cookware item. The one or more inputs may include a user input for a desired cooking temperature, a desired food temperature, or the like. The target temperature may be stored, for example, on an onboard memory.

At step 804, method 800 may include detecting a low heat condition at the cookware item in response to determining the target temperature. In detail, the method 800 may include continually or repeatedly monitoring the actual temperature at the cookware item during a cooking operation. The actual temperature may be monitored via one or more onboard temperature sensors. For instance, the one or more onboard temperature sensors may be coupled directly to the cookware item. However, the one or more temperature sensors may alternatively be positioned within a food item, at the first and second heating elements, or the like.

The method 800 may thus include continually or repeatedly comparing the actual temperatures (e.g., detected at a corresponding temperature sensor) with the target temperature. The method 800 may include determining that a low heat condition exists at the cookware item during the cooking operation. For instance, the low heat condition may be an actual temperature that is between 2 and 5 degrees less than the target temperature. It should be noted that this range is given by way of example only and that any suitable temperature difference may be used to determine the low heat condition.

At step 806, method 800 may include selectively opening a supplemental line valve in response to detecting the low heat condition. For example, with respect to cooktop appliance 100, the method 800 includes opening supplemental line valve 1026 upon determining that the low heat condition is satisfied at the cookware item. Accordingly, additional fuel is supplied to each of the first heating element and the second heating element in concert to identically adjust the heat output of each heating element. For instance, according to the automatic cooking mode, the method 800 may include automatically opening the supplemental line valve (e.g., without a direct input to the first control input). Advantageously, an even cooking process across the entire cookware item is ensured.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance defining a vertical direction, a lateral direction, and a transverse direction, the cooktop appliance comprising:

a first gas heating element;

a second gas heating element adjacent to the first gas heating element;

a first supply line in upstream fluid communication with the first gas heating element to direct fuel thereto;

a second supply line in upstream fluid communication with the second gas heating element to direct fuel thereto;

a first supply valve provided on the first supply line upstream from the first gas heating element;

a second supply valve provided on the second supply line upstream from the second gas heating element;

a supplemental line providing fluid connection from the first supply valve to each of the first supply line and the second supply line, the supplemental line comprising a bridge portion fluidly connected between the first supply line and the second supply line and a source portion fluidly connecting the first supply valve to the bridge portion;

a supplemental line valve provided on the supplemental line; and a controller operably coupled with the supplemental line valve, the controller being configured to selectively open the supplemental line valve.

2. The cooktop appliance of claim 1, further comprising:

a manifold comprising a gas inlet, wherein the first supply valve and the second supply valve are fluidly coupled to the manifold.

3. The cooktop appliance of claim 2, further comprising:

a first control input operably coupled with the first supply valve; and a second control input operably coupled with the second supply valve.

4. The cooktop appliance of claim 3, wherein the supplemental line valve is provided on the source portion.

5. The cooktop appliance of claim 4, wherein the supplemental line valve is a normally closed solenoid valve.

6. The cooktop appliance of claim 4, wherein the controller is configured to perform an operation, the operation comprising:

determining that a setting of the first control input and a setting of the second control input are matched;

detecting a presence of a cookware item covering both the first gas heating element and the second gas heating element; and enabling a predetermined cooking mode in response to determining the setting of the first and second control inputs and detecting the presence of the cookware item.

7. The cooktop appliance of claim 6, further comprising a temperature sensor configured to determine a temperature at the cookware item, wherein the operation further comprises:

determining a target temperature of the cookware item;

determining a low heat condition at the cookware item after determining the target temperature of the cookware item; and selectively opening the supplemental line valve in response to determining the low heat condition such that fuel is supplied to each of the first and second gas heating elements.

8. The cooktop appliance of claim 7, further comprising:

a bridge valve, the bridge valve being provided on the bridge portion between the second supply line and a connection point between the source portion and the bridge portion, and wherein the operation further comprises:

opening the bridge valve in response to enabling the predetermined cooking mode.

9. The cooktop appliance of claim 8, wherein the operation further comprises:

detecting a user input via the first control input regarding a temperature change;

opening the bridge valve; and selectively opening the supplemental line valve in response to detecting the user input such that fuel is supplied to each of the first and second gas heating elements.

10. The cooktop appliance of claim 6, wherein the setting of the first control input and the setting of the second control input each produce a minimum fuel flow.

11. A method for controlling a cooktop appliance, the cooktop appliance comprising a first heating element controlled by a first control input, a second heating element adjacent to the first heating element, the second heating element controlled by a second control input, a first supply line selectively supplying a fuel to the first heating element, a second supply line selectively supplying a fuel to the second heating element, the second supply line being in fluid parallel with the first supply line, a manifold comprising a gas inlet, wherein the first and second supply lines are fluidly coupled to the manifold, a supplemental line providing fluid connection between the first supply line and the second supply line, the supplemental line comprising a bridge portion fluidly connected between the first supply line and the second supply line and a source portion fluidly connected between the bridge portion and the manifold, and a supplemental line valve provided on the supplemental line, the method comprising:

determining that a setting of the first control input and a setting of the second control input are matched;

detecting a presence of a cookware item covering both the first heating element and the second heating element; and enabling a predetermined cooking mode in response to determining the setting of the first and second control inputs and detecting the presence of the cookware item.

12. The method of claim 11, wherein the supplemental line valve is provided on the source portion, and wherein the cooktop appliance further comprises:

a bridge valve, the bridge valve being provided on the bridge portion between the second supply line and a connection point between the source portion and the bridge portion.

13. The method of claim 12, further comprising:

determining a target temperature of the cookware item;

opening the bridge valve;

detecting a low heat condition at the cookware item; and selectively opening the supplemental line valve in response to determining the low heat condition such that fuel is supplied to each of the first and second heating elements.

14. The method of claim 12, further comprising:

detecting a user input via the first control input regarding a temperature change;

opening the bridge valve; and selectively opening the supplemental line valve in response to detecting the user input such that fuel is supplied to each of the first and second heating elements.

15. The method of claim 14, wherein each of the bridge valve and the supplemental line valve is a solenoid valve.

16. The method of claim 12, wherein the setting of the first control input and the setting of the second control input are each a minimum fuel flow setting.

* * * * *